United States Patent [19]

Matievich

[11] Patent Number: 4,494,332

[45] Date of Patent: Jan. 22, 1985

[54] FIREARM CAPABLE OF FIRING DIFFERENT-SIZED CARTRIDGES

[76] Inventor: Michael Matievich, 380 Pennsylvania Ave., Wilmerding, Pa. 15148

[21] Appl. No.: 480,728

[22] Filed: Mar. 31, 1983

[51] Int. Cl.[3] ..... F41C 1/00; F41C 21/06; F41C 21/12

[52] U.S. Cl. ..... 42/77; 42/59; 42/75 C

[58] Field of Search ..... 42/77, 59, 75 B, 75 C; 89/29

[56] References Cited

U.S. PATENT DOCUMENTS

| | | | |
|---|---|---|---|
| 151,882 | 6/1874 | Jones | 42/59 |
| 4,041,633 | 8/1977 | Scrufari | 42/59 |
| 4,288,938 | 9/1981 | Kahn | 42/77 |
| 4,357,774 | 11/1982 | Badger | 42/59 |

FOREIGN PATENT DOCUMENTS

| | | | |
|---|---|---|---|
| 316732 | 8/1929 | United Kingdom | 42/77 |

*Primary Examiner*—Charles T. Jordan
*Assistant Examiner*—Ted L. Parr
*Attorney, Agent, or Firm*—Thomas H. Murray; Clifford A. Poff

[57] ABSTRACT

A firearm capable of firing different-sized cartridges by the use of a detachable chamber having a plurality of bores extending therethrough. Each bore is adapted to receive a different-sized cartridge. The chamber is carried on a firearm receiver and can be positioned such that any one of the aforesaid bores in the chamber is aligned with the axis of the receiver.

5 Claims, 2 Drawing Figures

FIREARM CAPABLE OF FIRING DIFFERENT-SIZED CARTRIDGES

BACKGROUND OF THE INVENTION

As is known, firearms, and particularly rifles, are designed to accommodate cartridges of only one size. That is, the chamber which receives the cartridges when the breech is closed, is usually an integral part of the rifle barrel and is designed for one caliber and one cartridge size. Thus, even though many rifles are of the same caliber, or essentially the same caliber and casing diameter, they can handle a cartridge with a casing of only one length.

SUMMARY OF THE INVENTION

In accordance with the present invention, a new and improved rifle construction is provided which can accommodate cartridges of different sizes. specifically, there is provided a firearm including a chamber formed from a single block of metal and having a plurality of parallel bores extending therethrough. Each of the bores is adapted to receive a different-sized cartridge casing, and particularly a cartridge casing of different length. Furthermore, each of the bores has a threaded forward end adapted to receive a rifle barrel. The chamber is carried on a firearm receiver and is capable of being positioned such that any one of the bores in the chamber is aligned with the axis of the receiver. In this manner, by simply aligning any one of the bores with the receiver, and by threading the rifle barrel into the opposite end of the bore, a cartridge of a particular casing size can be accommodated. In order to change the cartridge size, the chamber is simply disconnected from the receiver and reinserted with another bore aligned with the receiver. The barrel can be unthreaded from one bore and threaded into another which is aligned with the receiver. Thus, a single barrel can be used for different cartridges of the same caliber but different casing sizes.

Figure 1:
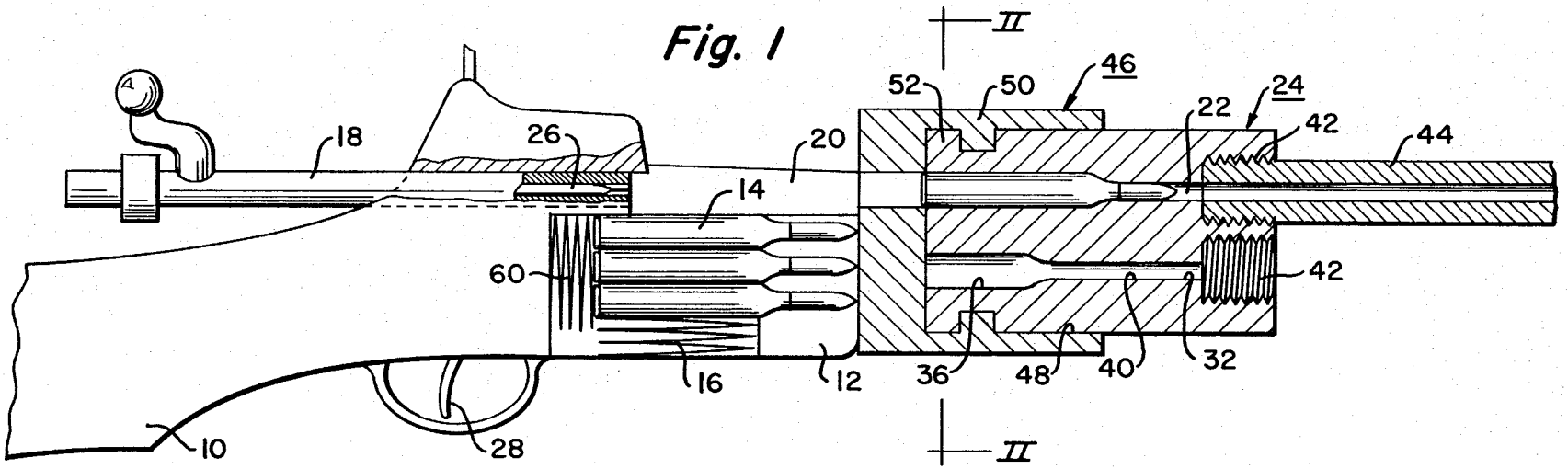
Figure 2:
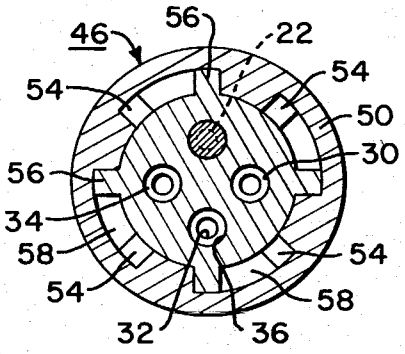

The above and other objects and features of the invention will become apparent from the following detailed description taken in connection with the accompanying drawings which form a part of this specification, and in which:

FIG. 1 is a partially broken-away elevational view of one embodiment of the invention; and FIG. 2 is a cross-sectional view taken substantially along line II—II of FIG. 1.

With reference now to the drawings, and particularly to FIG. 1, the firearm shown includes a stock member 10 having at its forward end a magazine 12 for receiving a clip or a plurality of cartridges. Cartridges 14 are urged upwardly by means of a spring member 16 such that when a bolt 18 is pulled backwardly as illustrated in FIG. 1, the uppermost cartridge 14 will spring into the cartridge receiver 20 of the firearm. The forward motion of the bolt 18 will then force the cartridge 14 into one of a plurality of bores or chambers 22 formed in a preferably circular firing chamber or cylinder member 24. As is conventional, the bolt 18 carries a firing pin 26 which is spring-loaded and which snaps forwardly to fire a cartridge within a bore 22 in the cylinder 24 when trigger 28 is pulled in accordance with usual practice.

As was explained above, a conventional rifle is provided with a single bore and receives a cartridge of a specified caliber and casing length. In accordance with the present invention, however, any one of a plurality of different-sized chambers can be aligned with the receiver 20 to receive a cartridge. Thus, and as best shown in FIG. 2, the cylinder 24 has four chambers 22, 30, 32 and 34 extending therethrough. In the illustration given, each of the chambers 22–34 has a rearward portion 36 of relatively large diameter which receives the cartridge casing and a forward, smaller diameter portion 40 which receives the bullet of the cartridge. Furthermore, each of the bores 22–34 is provided with a threaded, enlarged diameter forward portion 42 adapted to receive the end of a rifle barrel 44. As is shown in FIG. 1, the enlarged diameter portion 36 of the two bores 32 and 22 are of different lengths to accommodate shell casings of different lengths, notwithstanding the fact that the forward portions 40 of each bore are of the same diameter or caliber. Thus, by aligning any one of the bores 22–34 with the receiver 20, and by threading the barrel 44 into the threaded opening 42 of the aligned bore, different-sized cartridges can be accommodated.

The cylinder 24 is received within a circular outer cylinder receiver 46. Cylinder receiver 46 has an internal bore having a forward portion 48 of constant diameter and a rear portion comprising a wall 50 having a slotted or notched portion 52. This is perhaps best shown in FIG. 2. The slotted portion of wall 50 is provided with openings 54 through which projections 56 on the cylinder can pass. In order to insert the cylinder 24 into cylinder receiver 46, the projections 56 are aligned with the openings 54. As the cylinder 24 is moved backwardly into the cylinder receiver, the projections 56 pass through the openings 54 in the notched portion of wall 50. At this point, by rotating the cylinder 24 in a clockwise direction as viewed in FIG. 2, the projections 56 will pass through arcuate slots 58 until, and after about 45° of rotation, the projections 56 will engage abutments formed in cylinder receiver 46.

In order to remove the cylinder 24 from cylinder receiver 46, the foregoing process is reversed. That is, the cylinder 24 is rotated in a counterclockwise direction as viewed in FIG. 2 until the projections 56 become aligned with the openings 54 in the notched portion of wall 50. At this point, the cylinder 24 can be pulled out of cylinder receiver 46. Furthermore, it will be appreciated that by rotating the cylinder 24 in one direction or the other prior to its being inserted into the receiver 46, any one of the bores 22–34 can be aligned with the cartridge receiver 20 to receive a different-sized cartridge.

It will be appreciated, of course, that the magazine 12 which receives the cartridges 14 must accommodate cartridges of different lengths. Accordingly, in addition to the spring 16, a second spring 60 is provided which will push the cartridges against the forward wall of the magazine regardless of their length. One of the springs 16 or 60 will be slotted so that the two will clear.

The apparatus of the invention can be used for rimmed or unrimmed ammunition. The trailing diameter of rimmed ammunition is larger than that of rimless ammunition of the same bullet diameter. In order that both types can be fired from the same firearm, the body of the bolt 18 and its forward face can be produced as two separate pieces, one of which will accommodate rimmed ammunition and the other of which will accommodate rimless types.

Although the invention has been shown in connection with a certain specific embodiment, it will be readily apparent to those skilled in the art that various changes in form and arrangement of parts may be made to suit requirements without departing from the spirit and scope of the invention. In this respect, it will be appreciated that the caliber of the bullets 24 of the respective cartridges can also be varied; however in this latter case barrels of different internal bore diameters must be employed.

I claim as my invention:

1. In a firearm assembly having a cartridge receiver and means for moving cartridges sequentially from the cartridge receiver into a firing chamber for sequential firing of the firearm, the combination for accommodating cartridges of different sizes comprising: a unitary firing chamber member having a plurality of parallel bores extending therethrough, each of said bores being adapted to receive a different-sized cartridge and each of said bores having means at its forward end for receiving a firearm barrel in alignment therewith, and said firing chamber member being adjustably carried on the firearm for positioning thereof with any selected one of said bores in alignment with the axis of the cartridge receiver whereby said selected one of said bores is effective as the firing chamber of the firearm.

2. The combination of claim 1 wherein said bores accommodate cartridges having the same caliber bullet but different-sized casings.

3. The combination of claim 2 including a single barrel which can be received in alignment with any one of said bores.

4. The combination of claim 1 wherein the forward end of each of said bores is internally threaded to receive threads on the end of a firearm barrel.

5. The combination of claim 1 including means for locking said firing chamber member within said firearm such that any one of said bores extending therethrough is aligned with the axis of the cartridge receiver.

* * * * *